United States Patent [19]

Kobayashi

[11] 4,335,061

[45] Jun. 15, 1982

[54] AUXILIARY FUEL SUPPLY DEVICE FOR INTERNAL COMBUSTION ENGINES

[75] Inventor: Hiroto Kobayashi, Kamakura, Japan

[73] Assignee: Walbro Far East, Inc., Kawasaki, Japan

[21] Appl. No.: 156,167

[22] Filed: Jun. 3, 1980

[30] Foreign Application Priority Data

Jun. 18, 1979 [JP] Japan ..... 54-082180[U]

[51] Int. Cl.[3] ..... F02M 1/16

[52] U.S. Cl. ..... 261/44 G; 123/187.5 R; 261/95; 261/DIG. 8; 261/DIG. 68

[58] Field of Search ..... 261/DIG. 8, DIG. 55, 261/95, 96, 99, DIG. 68, 44 G; 123/187.5 R

[56] References Cited

U.S. PATENT DOCUMENTS

| | | | |
|---|---|---|---|
| 817,641 | 4/1906 | Harris | 261/DIG. 8 |
| 1,038,300 | 9/1912 | Crone | 261/DIG. 8 |
| 1,098,827 | 6/1914 | Munroe | 261/99 |
| 1,162,804 | 12/1915 | Penquite | 123/187.5 R |
| 1,164,931 | 12/1915 | Clairmont | 123/187.5 R |
| 1,280,463 | 10/1918 | Henes | 261/DIG. 8 |
| 1,448,215 | 3/1923 | Hasbrouck | 123/187.5 R |
| 2,606,751 | 8/1952 | Lacoste | 261/95 |
| 3,272,485 | 9/1966 | Newman | 261/99 |
| 3,494,343 | 2/1970 | Nutten | 261/DIG. 8 |
| 3,695,593 | 10/1972 | Postlethwaite | 261/96 |
| 3,838,673 | 10/1974 | Csicsery et al. | 123/187.5 R |
| 3,991,724 | 11/1976 | Geiser | 261/99 |

*Primary Examiner*—Tim R. Miles

*Attorney, Agent, or Firm*—Barnes, Kisselle, Raisch & Choate

[57] ABSTRACT

In a carburetor for furnishing fuel to internal combustion engines and utilizing a cylindrical rotary throttle valve as the venturi of the mixing passage, the addition of a fuel retaining means of absorbent material to prevent the puddling of unused fuel during the idling cycle and thus avoiding the problem of an overrich mixture when the carburetor is moved to another position.

3 Claims, 2 Drawing Figures

AUXILIARY FUEL SUPPLY DEVICE FOR INTERNAL COMBUSTION ENGINES

REFERENCE TO RELATED APPLICATION

Reference is made to my copending application, entitled "Carburetor With Rotary Throttle," Ser. No. 156,179, filed simultaneously with this application.

FIELD OF INVENTION

The design pertains to an auxiliary fuel supply device to supply auxiliary fuel to an internal combustion engine.

BACKGROUND OF INVENTION

To promote the starting efficiency of internal combustion engines, in addition to fuel from the fuel supply function of the carburetor, it is especially desirable to provide an auxiliary fuel supply device and particularly for the carburetors of two-cycle engines which are used as the driving power source for chain saws and trimmers.

It is required that a carburetor for an internal combustion engine, used as the driving power source to chain saws or trimmers, can control said engine operation properly in any position. One carburetor that fulfills this requirement is the diaphragm carburetor which has a fuel supply function including a fuel pump that works by working pressure of internal combustion engines, and a diaphragm chamber that leads the fuel to the fuel nozzle without fail by the pressurized flow from said pump regardless of the carburetor's position.

When an engine is in operation, a certain amount of fuel necessary to keep the engine operating is supplied to the air intake of the carburetor which is an integral part of the air intake passage of said engine. To control this, the fuel is supplied to said diaphragm chamber through an inlet needle valve, operated by an interconnected diaphragm which subdivides a diaphragm chamber in the body of the carburetor. Thus, a certain amount of fuel can be reserved in said diaphragm chamber. However, if an insufficient amount of fuel is in said diaphragm chamber for starting said engine, for instance, in starting the engine in cold climate or restarting it after fuel is depleted, a repeated operation of a primer pump is necessary in order to provide sufficient fuel in the diaphragm chamber prior to starting the engine.

This primer operation makes it possible to provide fuel in the diaphragm chamber when the fuel pump is not in operation.

It is, of course, desirable to feed an enriched fuel mixture to the engine at the time of starting in order to make it easy, but the normal adjustments to provide the proper amount of fuel from the nozzle to meet the normal requirement of the engine do not permit this. Further, it is necessary to have a choke device to minimize the air flow in order to obtain a desired enriched mixture to said engine. Such complexity in structure has been a shortcoming.

It is an object of the present invention to provide a simple auxiliary fuel supply device to supply auxiliary fuel to an engine for easy starting without the use of a choke system.

Briefly, this is accomplished by providing a fuel retainer means made of an absorbent material, in the air intake passage, leading to an air supply inlet of the internal combustion engine through the carburetor such that the fuel retainer means can store a sufficient amount of auxiliary fuel necessary to start the engine.

According to this invention, the retainer means does maintain a quantity of auxiliary fuel regardless of the position of the carburetor and engine, and the auxiliary fuel will not directly flow into the air inlet of the engine through the air intake passage to cause stoppage of the engine. The enriched fuel mixture supplied to the engine for starting will be a mixture of intake air from the air intake passage and the fuel derived from the fuel supply retainer of the carburetor. This simple expedient facilitates the starting of the engine without prior choke system.

Objects and features of this design will further appear from the following explanation along with the exemplary embodiment shown in the drawings.

BRIEF DESCRIPTION OF THE DRAWINGS

DRAWINGS accompany the disclosure and the various views thereof may be briefly described as.

DETAILED DESCRIPTION OF THE DRAWINGS

Figure 1:
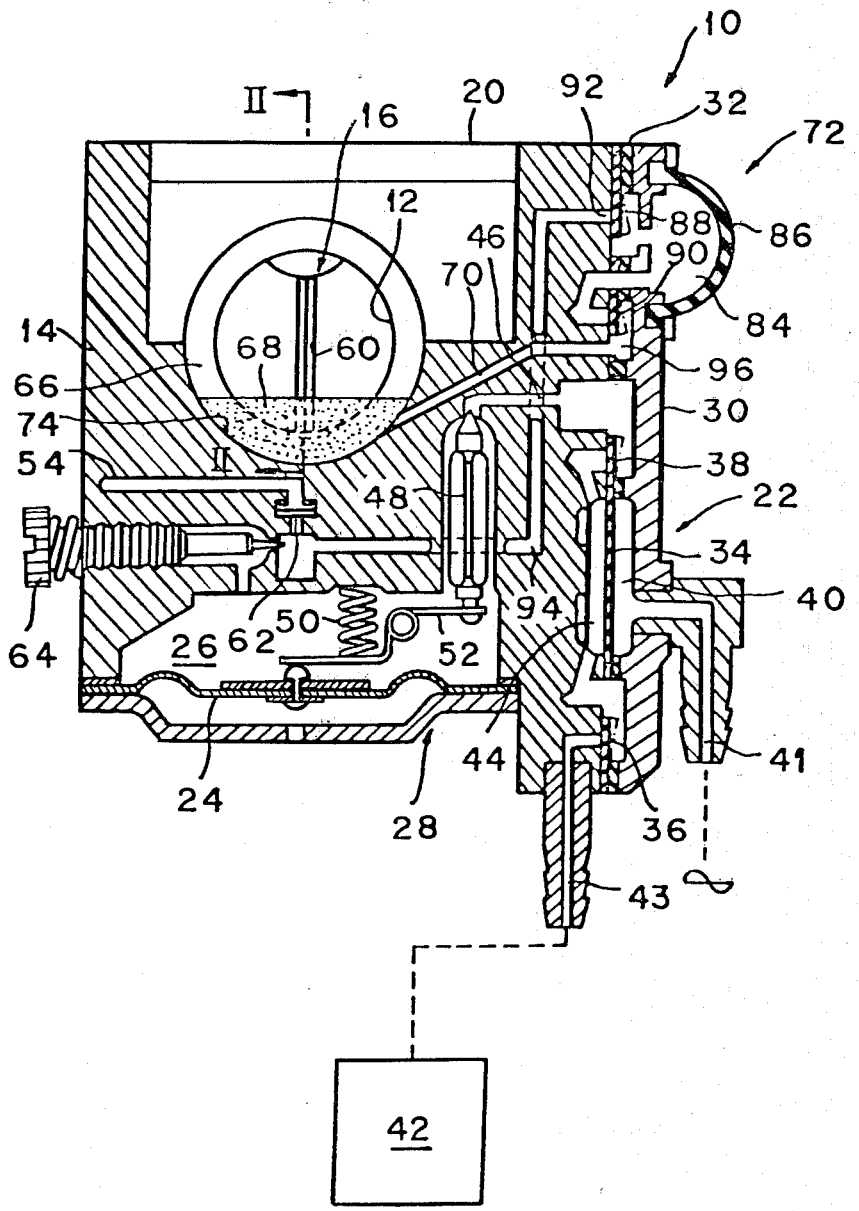
FIG. 1, a vertical section through a carburetor showing the functional parts.

With reference to the drawings, a carburetor 10 is shown embodying the invention. The carburetor 10 is provided with a carburetor body 14 with an orifice 12 formed therein, and a rotary throttle valve 16 is mounted in the body having an opening equal to the effective diameter of said air orifice 12. One end 18 of said air orifice 12 opens to one side of the carburetor body 14 as readily can be seen in FIG. 2 which shows a sectional part of the carburetor 10.

Figure 2:
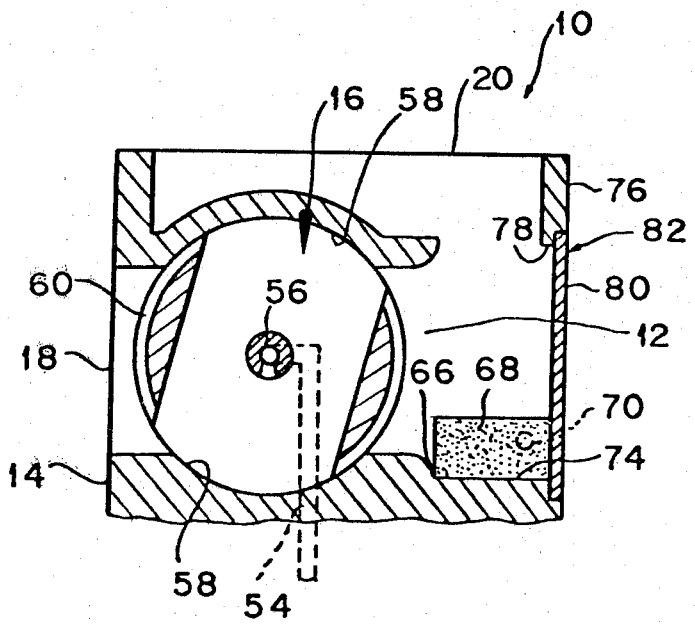
FIG. 2, a section on line II—II of FIG. 1.

Although not illustrated, the end of said opening is connected with an internal combustion engine, for example, a two-cycle engine air inlet. The other end 20 of the air orifice 12 opens to upward of the carburetor body 14 as shown in FIG. 2, and said end opening 20 is connected with an air cleaner through an air pipe not illustrated. The air pipe, air orifice 12, and air intake provide an air intake passage for said engine.

As shown in FIG. 1, the carburetor 10 is provided with a fuel supply device 28 as has well been known, which includes a fuel pump 22, and a diaphragm chamber 26, part of which is formed by a recess in the body and defined by diaphragm 24.

The fuel pump 22 is a diaphragm pump that is known. The pump consists of a diaphragm 34, together with seal material 32, which is held between the carburetor body 14 and a cover 30, along with a pair of check valves 36 and 38. The pulsing crankcase pressure of the engine, e.g., the crank chamber pressure of the two-cycle engine, will be introduced into the diaphragm chamber 40, formed on the outside of the diaphragm 34 through the opening 41.

Consequently, when the engine is operating, as has well been known, the pump 22 sucks in fuel from the fuel tank 42 into the pump chamber 44, formed on the other side of the diaphragm 34, through the opening 43 and one of the check valves 36. This fuel will be transferred under pressure into diaphragm chamber 26 through the passage 46 from the other check valve 38.

In the diaphragm chamber 26, an inlet needle valve 48 is provided for intermittently opening and closing passage 46. The inlet needle valve 48 is connected with the diaphragm 24 and through a swing lever 52 that is biased by the spring 50. As has been well known, because of the intermittent functioning of said inlet needle valve 48, fuel will intermittently be taken via the passage 46 into the diaphragm chamber 26 and thence to the engine. With this function, a proper amount of fuel is normally reserved in the diaphragm chamber 26.

Fuel in this diaphragm chamber 26 will be guided to the fuel nozzle 56 (FIG. 2) of the rotary throttle valve 16 via the fuel supply passage 54. By the suction of the engine, the guided fuel will be sucked into the air orifice of the carburetor 10, an integral part of the air passage, and then will be mixed with air taken into the air cleaner. This mixture will be supplied to the engine through the air supply passage 12. According to the example on the drawings, there is a fuel guide groove 60 that leads the fuel from the concavity 58 into the engine. The groove is provided in the exterior circumference of the throttle valve 16 for the purpose of preventing fuel from collecting in the concavity 58. The concavity is formed with the throttle valve 16 and the carburetor body 14. In fuel supply passage 54, a check valve 62 is fixed to prevent air counterflow into the diaphragm chamber 26 from said supply passage 54 when operating the primer as explained later. There is also an adjustable needle 64 to adjust fuel provided.

Normal operation of the engine following its starting can be ideally maintained with the fuel supply from the fuel supply device 28 and in response to the throttle valve 16 functioning. However, at the engine starting, sufficient mixture of fuel to raise its starting capability cannot be supplied to the engine with only fuel from said nozzle 56 of the fuel supply device.

For the purpose of raising the starting capability of the engine, the auxiliary fuel supply device, in accordance with this invention, is provided with the carburetor 10. This auxiliary fuel supply device comprises the following: the fuel retainer means 68 of absorbent material, installed in the concavity 66 locating at the air cleaner side, i.e., upstream side from the throttle valve 16 to said air orifice 12. A fuel passage 70 is provided to guide auxiliary fuel to the retainer means 68 at the starting from the auxiliary fuel supply device 72 (FIG. 7).

The fuel retainer means is made of a sponge material 68 in a block style as shown on the illustrated example. This sponge material is housed in the concavity 66 and with its bottom bonded onto the wall of the concavity. The fuel retainer means can be made of water absorbent material, various oil resistant materials, and of porous material, oil resistant, such as cast metallic material in lieu of said sponge material.

As indicated in FIG. 2, the illustration shows an aperture 82 forming an opening 78 and closed by a light transparent disc material 80. This aperture is provided on the side wall 76 opposite to the other side wall of the carburetor body 14, a part of the aperture including the concavity 66, and on the portion of the carburetor where the air orifice 12 opens. This aperture is not necessary, but in supplying auxiliary fuel to the retainer means, and for preventing fuel overflow from said retainer means, the aperture 82 is desirable for observation purposes. A clear synthetic resin is preferred to be used to close the aperture at 80. The aperture 82 need not necessarily be located at the side wall 76, but should be in a location from where said retainer means 68 can be watched from outside of said carburetor 10.

The auxiliary fuel guiding passage 70 leading to the retainer means is formed in the carburetor body 14, and one end of said guiding passage 70 is connected with a supply device 72. The other end of said guiding passage 70 opens at the concavity wall 74 where the retainer means 68 is bonded. The other end of the passage 70 is located at a position where the fuel from the passage 70 may be directed to the retainer means 68 to the top or side of the retainer means 68.

It is desired to make the other end of the guiding passage 70 open to the wall 74, as mentioned above, to make the fuel flow from said guiding passage 70 to said retainer means 68 without fail and regardless of the position of the carburetor.

According to the example shown in FIG. 1, the supply device 72 is a pump consisting of a resilient cap 86, which is fixed on the cover 30 to provide a pump chamber 84, with a pair of check valves 88 and 90. With respect to the structure and a simplification in assembly, it is advantageous to build in to one resilient sheet the check valves 88 and 90, the diaphragm 34 of the fuel pump 22 and the check valves 36 and 38. The suction port 92 of the pump 72, with which the check valve 88 of one end is associated, opens to the fuel supply passage 54 through the passage 94, built in the carburetor body 14. The exhaust opening 96 of the pump 72, with which the other check valve 90 is associated, opens to the guiding passage 70.

According to the example shown in FIG. 1, the passage 94 opens to the fuel supply passage 54 in between said check valve 62 and needle 64, and said passage 94 is connected to the diaphragm chamber 26 via the fuel supply passage 54. In lieu of this, said passage can be directly made open to the diaphragm chamber 26. But, for the sake of preventing an excessive fuel supply in high speed operation of the engine after it is started, as illustrated, it is desirable to make the passage 94 open to the fuel supply passage 54 at the fuel nozzle 56 side rather than the needle 64 side.

Prior to starting of the engine, the auxiliary fuel supply device, pump 72 is manually operated. As the resilient cap 86 is repeatedly pressed from the manual operation, a suction pressure functions in the diaphragm chamber 26 by suction of the pump 72. By the suction, the fuel of the fuel tank 42 will be guided to the diaphragm chamber 26 through the fuel pump 22 regardless of non-operation of the engine, i.e., non-working of the fuel pump 22. So the pump 72 functions as a suction primer pump. When fuel is filled in said diaphragm chamber 26 by pump 72, and with the subsequent manual operation of pump 72, excess fuel will be transferred to said retainer means 68 via said passage 94, the pump chamber 82 and the guiding passage 70. This retainer means 68, from its absorbent capability, does positively absorb and retain the fuel supplied through the retainer means, and the retainer fuel can serve as auxiliary fuel.

The auxiliary fuel, absorbed and retained by the retainer means 68, can positively be retained in the retainer means 68 as long as no suction pressure functions on the suction passage 12 and regardless of the carburetor 10 position. So no retaining fuel will directly run into the air inlet of the engine when it is not in operation. When suction pressure is produced by the starting of the engine, the retaining fuel will be mixed with fuel from the fuel nozzle 56 together with air taken from the air cleaner entering the opening 20. Then the mixture of fuel and air through the above process will in sequence be supplied to said engine. Thus, the starting of the engine will be facilitated.

FIGS. 1 and 2 show examples of the auxiliary fuel retainer means 68 being installed at an upstream position from the throttle valve 16. As a replacement for the above, the retainer means may be installed in the throttle bore of the throttle valve 16 or at the down current side from the throttle valve 16. However, in idling operation after starting the engine, and for the sake of preventing the fuel retainer means from trapping of the fuel from fuel nozzle 56, it is desired to install the retainer means on the upstream side as illustrated. Without providing said concavity 66, the retainer means can be directly bonded on the wall of air passage 12 which includes the air orifice 12. In order to avoid increasing the resistance against the air current in the air supply passage 72, it is desired to provide the concavity 66 as aforementioned, in which concavity said retainer means is to be housed.

The foregoing description pertains to an example where the suction primer pump is utilized as a fuel supply device. It is possible to utilize a pressurized primer pump, as has well been known in prior time, as a fuel supply device. Also, a fuel supply device can be provided separate from the primer pump. However, for the diaphragm system carburetor, it is desired to utilize the primer pump as the fuel supply device to assist in adapting the carburetor 10 to a compact size.

The auxiliary fuel supply device, developed from this design, can be built in with a diaphragm carburetor provided with a butterfuly throttle valve as well as a float system carburetor with a float that has well been known. Further the auxiliary fuel supply device may be provided with some other part; for instance, said air pipe or suction air passage, other than the carburetor, that is an integral part of an air supply passage of an internal combustion engine.

According to the auxiliary fuel supply device developed from this design, the fuel supplied to the retainer means will positively be absorbed and maintained by said retainer means as the auxiliary fuel regardless of the engine position. Since the auxiliary fuel will be sucked into said engine by negative suction pressure in sequence following starting of internal combustion engine, it makes it possible to raise the mixture strength at the starting of said internal combustion engine. From this effect and with this simple structure, the starting characteristics of the internal combustion engine are greatly improved without making use of a choke device which controls the amount of air intake.

I claim:

1. In a carburetor body having a fuel and air mixing passage for supplying fuel to an internal combustion engine, said carburetor body having a fuel chamber, an air inlet passage, a main fuel nozzle to said air inlet passage, a throttle valve and an outlet for fuel and air mixture, a design to improve the fuel flow to assist in the starting of an engine in the absence of a choke valve which comprises:

(a) a body of porous absorbent material in the carburetor body upstream of said throttle valve to serve as a fuel retaining storage reservoir located on one side of the air inlet passage in the body of said carburetor and upstream from the main fuel inlet, (b) a fuel passage in said carburetor body independent of the main fuel inlet to carry liquid fuel to the interior of said porous body, and (c) a pressure means on said body to direct liquid fuel from said fuel chamber in said body through said fuel passage to the interior of said body of porous absorbent material preparatory to the starting of an engine.

2. A carburetor body as defined in claim 1 in which said body of porous absorbent material is shaped as a chordal segment of a cylinder and positioned in a recess in said body having a wall portion to interfit with the curved wall of said segment.

3. A carburetor as defined in claim 1 in which said carburetor body has a diaphragm fuel chamber supplied by a pulse pump operated by crankcase pressures whereby fuel is supplied to the main fuel nozzle from said chamber, and said pressure means comprises a manually operable primer pump on said carburetor body having an inlet passage and inlet valve connected to said diaphragm fuel chamber, and an outlet passage and outlet valve connected to said fuel passage to carry liquid fuel from said fuel chamber to said body of porous absorbent material.

* * * * *